US010099910B2

(12) United States Patent
Deer

(10) Patent No.: US 10,099,910 B2
(45) Date of Patent: Oct. 16, 2018

(54) SCREW-LID REMOVAL AND ATTACHMENT DEVICE

(71) Applicant: Diane Deer, Pensacola, FL (US)

(72) Inventor: Diane Deer, Pensacola, FL (US)

( * ) Notice: Subject to any disclaimer, the term of this patent is extended or adjusted under 35 U.S.C. 154(b) by 331 days.

(21) Appl. No.: 15/007,446

(22) Filed: Jan. 27, 2016

(65) Prior Publication Data

US 2017/0210607 A1 Jul. 27, 2017

(51) Int. Cl.
*B67B 7/18* (2006.01)
*B67B 3/20* (2006.01)

(52) U.S. Cl.
CPC ..... *B67B 7/18* (2013.01); *B67B 3/2006* (2013.01)

(58) Field of Classification Search
CPC .... B67B 7/14; B67B 7/15; B67B 7/18; B67B 3/2006
See application file for complete search history.

(56) References Cited

U.S. PATENT DOCUMENTS 1,887,152 A * 11/1932 Geisler ..... B67B 7/18 215/376
1,913,906 A * 6/1933 Swenson ..... B67B 7/18 192/47
1,960,531 A * 5/1934 Driscoll ..... B67B 3/2006 279/102
2,246,649 A * 6/1941 West ..... B67B 7/18 81/3.4
2,519,447 A * 8/1950 Ensminger ..... B67B 7/18 81/3.4
2,985,044 A 5/1961 Gill
3,604,290 A * 9/1971 Waite ..... B67B 7/182 81/3.4
3,730,025 A 5/1973 Monnerjahn
3,812,741 A * 5/1974 Heine ..... B67B 7/18 7/151
3,919,901 A * 11/1975 Braman ..... B67B 7/18 215/277
4,090,419 A 5/1978 Abraham
4,337,678 A * 7/1982 Mumford ..... B67B 7/18 81/3.4
4,414,865 A * 11/1983 Brooks ..... B67B 7/18 81/3.09
4,702,129 A 10/1987 Allen
4,760,763 A * 8/1988 Trick ..... B67B 7/18 81/3.09
5,517,881 A 5/1996 Burns
5,893,301 A * 4/1999 Hensley ..... B67B 7/18 7/156

(Continued)

*Primary Examiner* — David B Thomas

(57) ABSTRACT

A screw-lid removal and attachment device for removal and attachment of screw-lids includes a housing that is tubular. The housing has an annular wall that is deformable and extends downwardly from a top, defining a bottom that is open. The bottom, which defines a cavity positioned in the housing, is substantially complementary to a lid to be removed or attached to a container. A grip is coupled to an exterior of the annular wall. A catch is coupled to an interior of the annular wall. The cavity is configured for insertion of a lid. The grip is configured to be grasped by the user to collapse the annular wall, such that the catch engages the lid. The grip is configured to allow the user to impart a counter-clockwise force to the housing for removal of the lid or a clockwise force to attach the lid.

13 Claims, 4 Drawing Sheets

(56) References Cited

U.S. PATENT DOCUMENTS

| | | | | |
|---|---|---|---|---|
| D440,843 | S | 4/2001 | Pitassi et al. | |
| 6,415,688 | B1 | 7/2002 | Smith | |
| 7,168,337 | B2 * | 1/2007 | Carmo | B67B 7/18 81/3.43 |
| 7,267,031 | B1 * | 9/2007 | Burton | B67B 7/18 81/3.09 |
| 7,748,293 | B2 * | 7/2010 | Elwell | B67B 7/18 7/151 |
| 9,187,305 | B1 * | 11/2015 | Olt | B67B 7/18 |
| 2005/0193867 | A1 * | 9/2005 | Haynes | B67B 7/18 81/3.4 |
| 2008/0072709 | A1 * | 3/2008 | Dye | B67B 7/16 81/3.09 |
| 2009/0145267 | A1 * | 6/2009 | Moles | B67B 7/16 81/3.37 |
| 2011/0006061 | A1 * | 1/2011 | Michiwaki | B65D 41/0485 220/260 |
| 2011/0220607 | A1 * | 9/2011 | Mukunoki | B29C 45/14 215/302 |

* cited by examiner

SCREW-LID REMOVAL AND ATTACHMENT DEVICE

BACKGROUND OF THE DISCLOSURE

Field of the Disclosure

The disclosure relates to lid removal and attachment devices and more particularly pertains to a new lid removal and attachment device for removal and attachment of screw-lids.

SUMMARY OF THE DISCLOSURE

An embodiment of the disclosure meets the needs presented above by generally comprising a housing that is tubular. The housing has an annular wall that is deformable and extends downwardly from a top, defining a bottom that is open. The bottom, which defines a cavity positioned in the housing, is substantially complementary to a lid to be removed or attached to a container. A grip is coupled to an exterior of the annular wall. A catch is coupled to an interior of the annular wall. The cavity is configured for insertion of a lid. The grip is configured to be grasped by the user to collapse the annular wall, such that the catch engages the lid. The grip is configured to allow the user to impart a counter-clockwise force to the housing for removal of the lid or a clockwise force to attach the lid.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
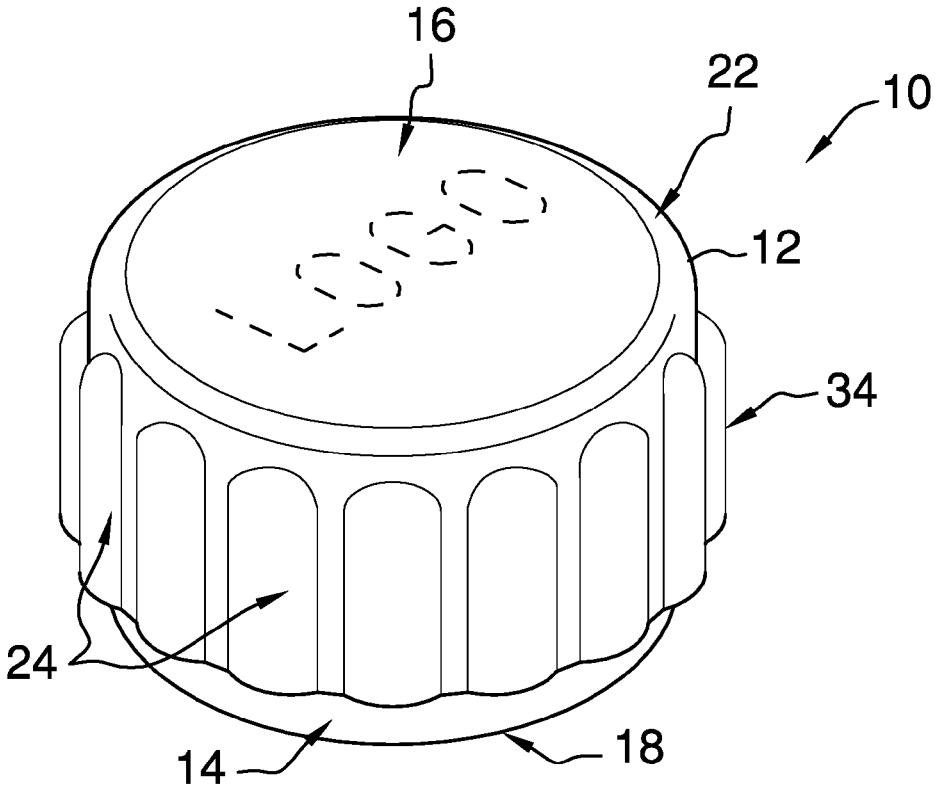
FIG. 1 is an isometric perspective view of a screw-lid removal and attachment device according to an embodiment of the disclosure.
Figure 2:
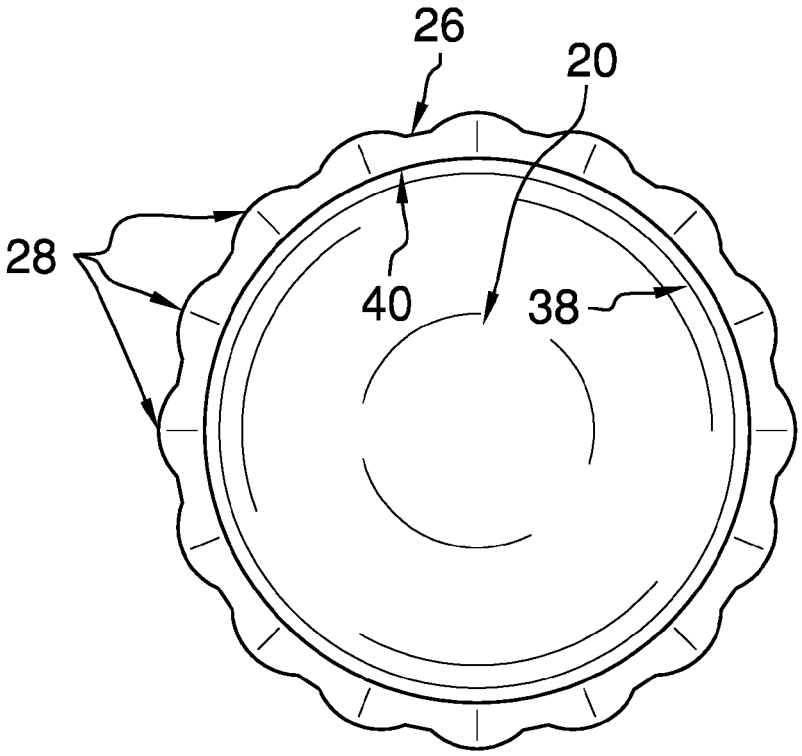
FIG. 2 is a bottom view of an embodiment of the disclosure.
Figure 3:
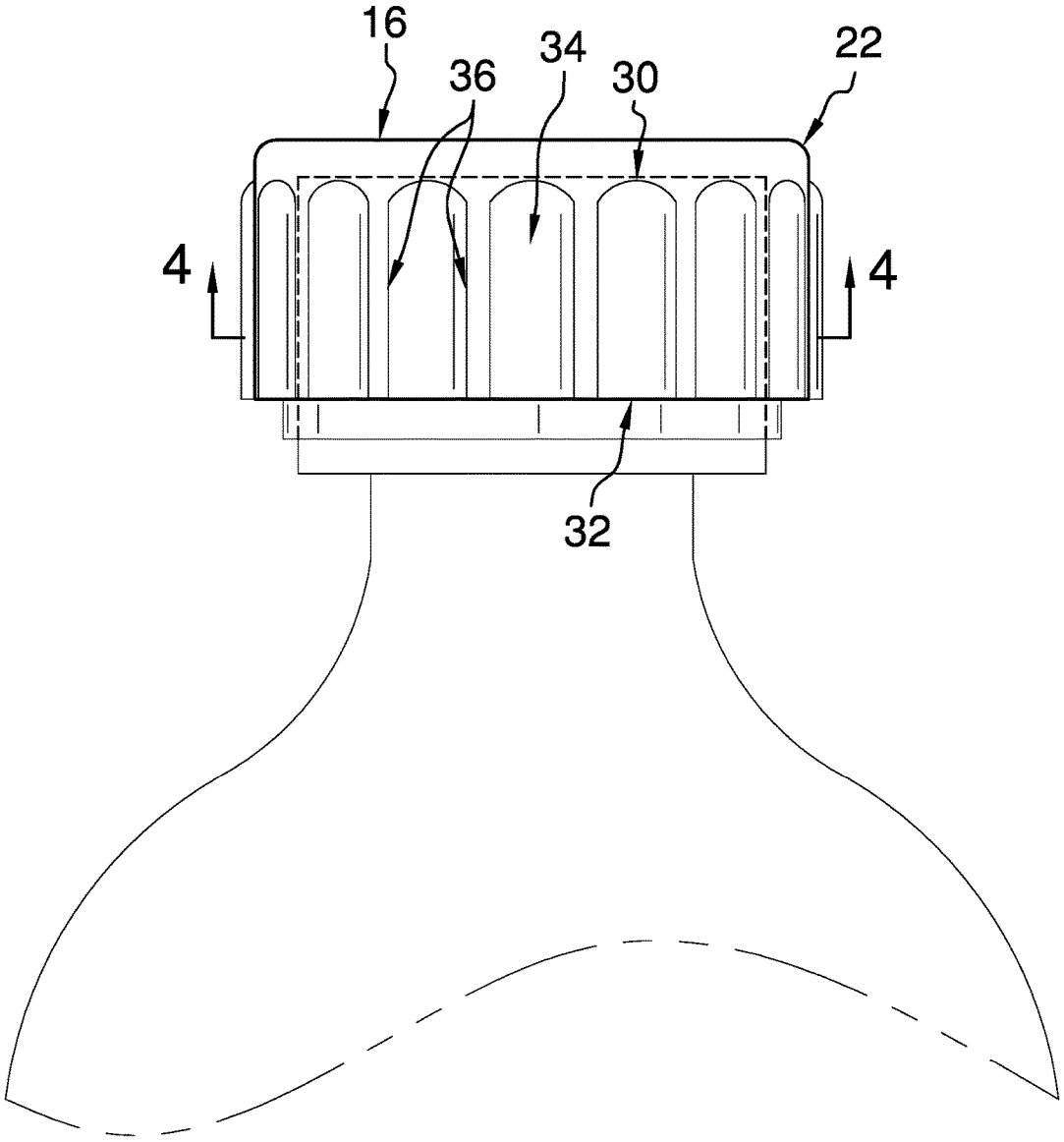
FIG. 3 is a side view of an embodiment of the disclosure.
Figure 4:
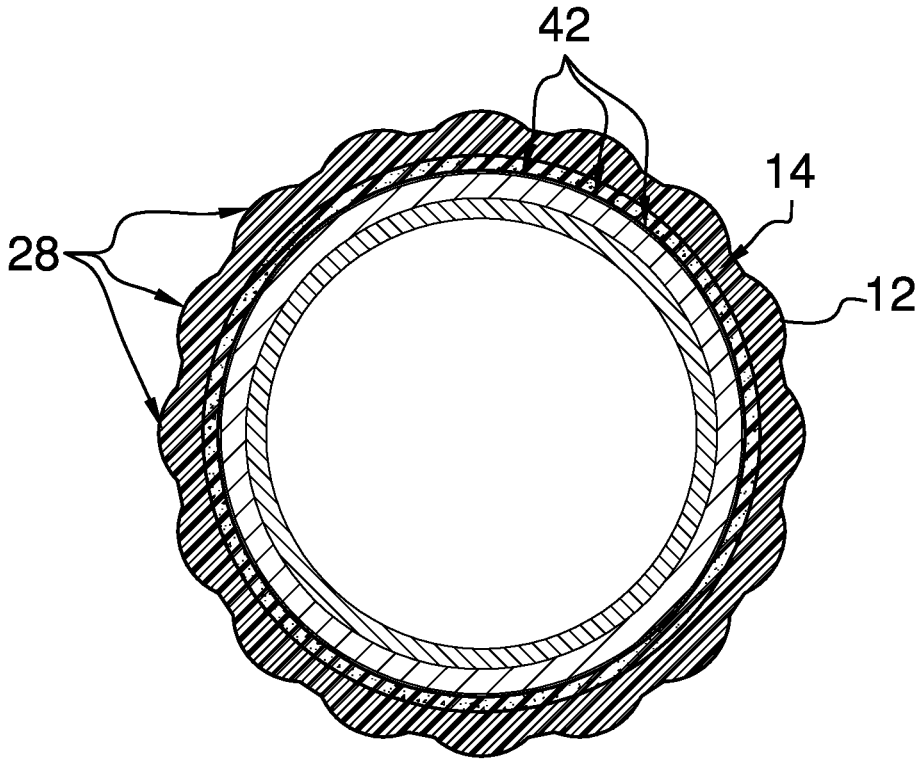
FIG. 4 is a cross-sectional view of an embodiment of the disclosure.
Figure 5:
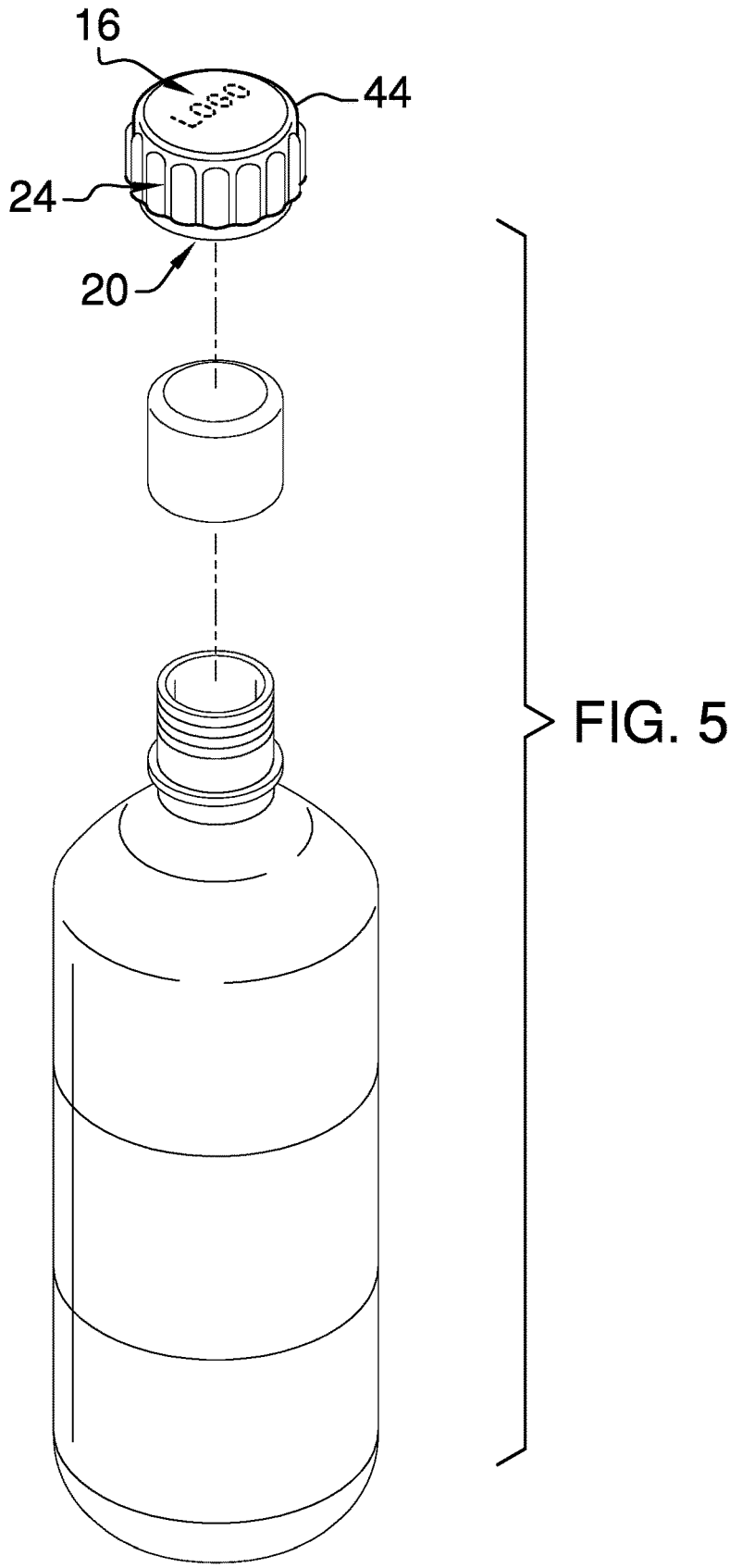
FIG. 5 is an in-use view of an embodiment of the disclosure.

With reference now to the drawings, and in particular to FIGS. 1 through 5 thereof, a new lid removal and attachment device embodying the principles and concepts of an embodiment of the disclosure and generally designated by the reference numeral 10 will be described.

As best illustrated in FIGS. 1 through 5, the screw-lid removal and attachment device 10 generally comprises a housing 12 that is tubular. The housing 12 has an annular wall 14 that extends downwardly from a top 16, defining a bottom 18. The annular wall 14 is deformable. The bottom 18 is open, defining a cavity 20 positioned in the housing 12. The bottom 18 is substantially complementary to a lid to be removed or attached to a container. The top 16 has a rim 22, which preferably is rounded.

A grip 24 is coupled to an exterior 26 of the annular wall 14. Preferably, the grip 24 comprises a plurality of ridges 28. Each ridge 28 extends from proximate to the top 16 to proximate to the bottom 18 of the annular wall 14. Each ridge 28 has an upper end 30 and a lower end 32. Preferably, the upper end 30 is arcuate and the lower end 32 is flat. Each ridge 28 has an outer surface 34 that extends between opposing sides 36 of the ridge 28 and from the upper end 30 to the lower end 32 of the ridge 28. Preferably, the outer surface 34 is arcuate, such that each the ridge 28 is rounded.

A catch 38 is coupled to an interior 40 of the annular wall 14. Preferably, the catch 38 comprises a plurality of cutouts 42. Each cutout 42 extends from proximate to the top 16 to proximate to the bottom 18 of the annular wall 14. The cutouts 42 are positioned to allow collapse of the annular wall 14 to engage a perimeter of a lid inserted into the cavity 20.

Preferably, the housing 12, the grip 24 and the catch 38 comprise rubber. More preferably, the housing 12, the grip 24 and the catch 38 comprise silicone.

The housing 12 may comprise a plurality of housings 44. Each of the housings 44 has a respective bottom 18 being substantially complementary to a respectively sized lid.

In use, the bottom 18 is configured for insertion of the lid into the cavity 20. The cutouts 42 are positioned to allow collapse of the annular wall 14. The grip 24 is configured to be grasped by the user to collapse the annular wall 14 such that the catch 38 engages the lid. The grip 24 is configured to allow the user to impart a counter-clockwise force to the housing 12 for removal of the lid or a clockwise force to attach the lid.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A screw-lid removal and attachment device comprising:

a housing, said housing being tubular, said housing having an annular wall extending downwardly from a top defining a bottom, said annular wall being deformable, said bottom being open defining a cavity positioned in said housing, said bottom being substantially complementary to a lid to be removed or attached to a container;

a grip, said grip being coupled to an exterior of said annular wall;

a catch, said catch being coupled to an interior of said annular wall, said catch being continuous extending fully around said interior of said annular wall; and wherein said bottom is configured for insertion of the lid into said cavity such that said catch is positioned around the lid, and wherein said grip is configured to be grasped by the user to collapse said annular wall such that said catch engages the lid, and wherein said grip is configured to allow the user to impart a counter-clockwise force to said housing for removal of the lid or a clockwise force to attach the lid.

2. The device of claim 1, further including said top having a rim, said rim being rounded.

3. The device of claim 1, further including said grip comprising a plurality of ridges.

4. The device of claim 3, further including each said ridge extending from proximate to said top to proximate to said bottom of said annular wall.

5. The device of claim 3, further including each said ridge having an upper end and a lower end, said upper end being arcuate.

6. The device of claim 5, further including said lower end being flat.

7. The device of claim 6, further including each said ridge having an outer surface extending between opposing sides of said ridge and from said upper end to said lower end of said ridge.

8. The device of claim 7, further including said outer surface being arcuate, such that each said ridge is rounded.

9. The device of claim 1, further including said catch comprising a plurality of cutouts, wherein said cutouts are positioned to allow collapse of said annular wall to engage a perimeter of a lid inserted into said cavity.

10. The device of claim 9, further including each said cutout extending from proximate to said top to proximate to said bottom of said annular wall.

11. The device of claim 1, further including said housing, said grip and said catch comprising rubber.

12. The device of claim 11, further including said housing, said grip and said catch comprising silicone.

13. A screw-lid removal and attachment device comprising:

a housing, said housing being tubular, said housing having an annular wall extending downwardly from a top defining a bottom, said annular wall being deformable, said bottom being open defining a cavity positioned in said housing, said bottom being substantially complementary to a lid to be removed or attached to a container, said top having a rim, said rim being rounded;

a grip, said grip being coupled to an exterior of said annular wall, said grip comprising a plurality of ridges, each said ridge extending from proximate to said top to proximate to said bottom of said annular wall, each said ridge having an upper end and a lower end, said upper end being arcuate, said lower end being flat, each said ridge having an outer surface extending between opposing sides of said ridge and from said upper end to said lower end of said ridge, said outer surface being arcuate, such that each said ridge is rounded;

a catch, said catch being coupled to an interior of said annular wall, said catch being continuous extending fully around said interior of said annular wall, said catch comprising a plurality of cutouts, each said cutout extending from proximate to said top to proximate to said bottom of said annular wall, wherein said cutouts are positioned to allow collapse of said annular wall to engage a perimeter of a lid inserted into said cavity;

said housing, said grip and said catch comprising rubber, said housing, said grip and said catch comprising silicone;

and wherein said bottom is configured for insertion of the lid into said cavity, wherein said cutouts are positioned to allow collapse of said annular wall, wherein said grip is configured to be grasped by the user to collapse said annular wall such that said catch engages the lid, and wherein said grip is configured to allow the user to impart a counter-clockwise force to said housing for removal of the lid or a clockwise force to attach the lid.

* * * * *